US005288024A

United States Patent [19]

Vitale

[11] Patent Number: 5,288,024

[45] Date of Patent: Feb. 22, 1994

[54] UNIVERSAL PNEUMATIC DEVICE FOR DOUGH-CASTING, POINTING AND FILLETING

[76] Inventor: Nicolas Vitale, 14 rue du 11 Novembre, 65600 Semeac, France

[21] Appl. No.: 791,859

[22] Filed: Nov. 14, 1991

[30] Foreign Application Priority Data

Jul. 26, 1991 [FR] France ..... 91 09921

[51] Int. Cl.[5] ..... B05B 7/30

[52] U.S. Cl. ..... 239/346; 239/654; 406/38; 406/191

[58] Field of Search ..... 406/191, 38, 144, 145; 239/600, 654, 345, 346

[56] References Cited

U.S. PATENT DOCUMENTS

| | | | |
|---|---|---|---|
| 1,331,987 | 2/1920 | Griffen | 406/191 |
| 1,718,507 | 6/1929 | Wenzel et al. | 406/144 |
| 4,863,104 | 9/1989 | Masterson | 406/38 |
| 5,039,017 | 8/1991 | Howe | 406/38 |

FOREIGN PATENT DOCUMENTS

| | | | |
|---|---|---|---|
| 221780 | 6/1962 | Austria | 239/345 |
| 1012744 | 7/1957 | Fed. Rep. of Germany | 239/346 |
| 207099 | 1/1960 | Fed. Rep. of Germany | 239/345 |
| 1123979 | 2/1962 | Fed. Rep. of Germany | 406/191 |
| 1123464 | 9/1956 | France | 239/345 |
| 479904 | 4/1953 | Italy | 239/345 |
| 517716 | 9/1953 | Italy | 239/345 |
| 525769 | 5/1955 | Italy | 239/345 |
| 588987 | 2/1959 | Italy | 239/345 |
| 363467 | 7/1962 | Switzerland | 239/345 |

*Primary Examiner*—Andres Kashnikow
*Assistant Examiner*—Christopher G. Trainor
*Attorney, Agent, or Firm*—Collard & Roe

[57] ABSTRACT

A universal pneumatic device for rough-casting, pointing and filleting is made up of a receptacle which includes an accessible compression chamber formed by two hollow half-shells assembled and screwed to the receptacle with a handle with connection to a compressed-air hose-pipe and valve. This structure is intended to make all the joinings of the device easily and rapidly accessible at the time of casting of paste for rough-casting, pointing or filleting in the construction industry and for public works.

5 Claims, 3 Drawing Sheets

UNIVERSAL PNEUMATIC DEVICE FOR DOUGH-CASTING, POINTING AND FILLETING

This invention relates to devices of the "TYROLESE" mason type, making it possible to cast a mortar in drop form under pressure.

Such devices are used under the grimy technical conditions found at construction sites; they frequently are maintained in a haphazard manner with relatively rudimentary engineering.

In known apparatus of this type, the traditional tyrolese is composed of a receptacle into which is poured the material which is to be cast. In this receptacle a metallic brush, which is moved manually with the aid of a crank, is partially submerged.

In another type of equipment, the required power derives from a compressed-air source to which the device is connected. Such is the case for this model.

There is a nevralgic point with this type of device which is located between the connection of the air-intake hose-pipe and the "receptacle" portion into which the paste or soft mortar to be cast is poured. This portion is metallic and is an integral part of the receptacle; it constitutes a nose-piece or compression chamber which is in accordance with the type of device perforated with one or several holes connecting with the base of the receptacle. The chamber is exposed to penetration by the mortar which, in time, clogs up the nose-piece and the orifices. In most cases, this fact leads to putting the device out of service prematurely because of the difficulty involved in scouring a hardened cement-based or plaster binding material on a metallic support and in clearing the rather small orifices.

The device according to the invention makes it possible to avoid these disadvantages. Indeed, it hereby is possible first to separate the chamber from the rest of the device and the equipment, then to disassemble the chamber into two half-shells. It thus is possible to have easy access to all the elements of the device for a thorough cleaning and maintenance.

The device which is the subject of the invention consists of a handle, to which the hose-pipe is connected, which also functions through a small valve provided with a lever, for opening-closing of the air intake. The whole is mounted in a line, with a connecting-box also removable, to the base of the receptacle of the device where the compression chamber is located. The handle is attached to the compression chamber by a union-nut connecting-box, with a hollow spindle, which permits circulation of air. The compression chamber is assembled and made up of two hollowed-out demi-components, then it is fitted together and screwed down in a cavity existing in the bottom of the receptacle. Among these three elements, a treatment is applied to guarantee the imperviousness of these assemblies, achieved by simple juxtaposition of flat metallic flanges. This treatment is either a joining paste or a flexible or pliable joint.

This compression chamber includes one or several compressed-air blower outlets, provided with nozzles. These air nozzles are screwed onto the demi-component of the compression chamber located on the inner side of the device and at its base. Afterwards, this compression chamber is attached to the device by the fastening of several awl screws the female threading of which is cut in the tank area of the main body of the receptacle of the device.

This arrangement offers an additional possibility for the device for interchangeability of the compression-chamber portion, for maintenance, for example, or for replacement if it is a matter of avoiding the potential for a technical problem in connection with the quality of the desired casting particle.

The device provided with a carrying handle includes at the base of its tank, on the side opposite the compression chamber, one of several outlet orifices on which is/are screwed one or several nose-pieces serving for expulsion of the mortar under pressure.

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

Figure 1:
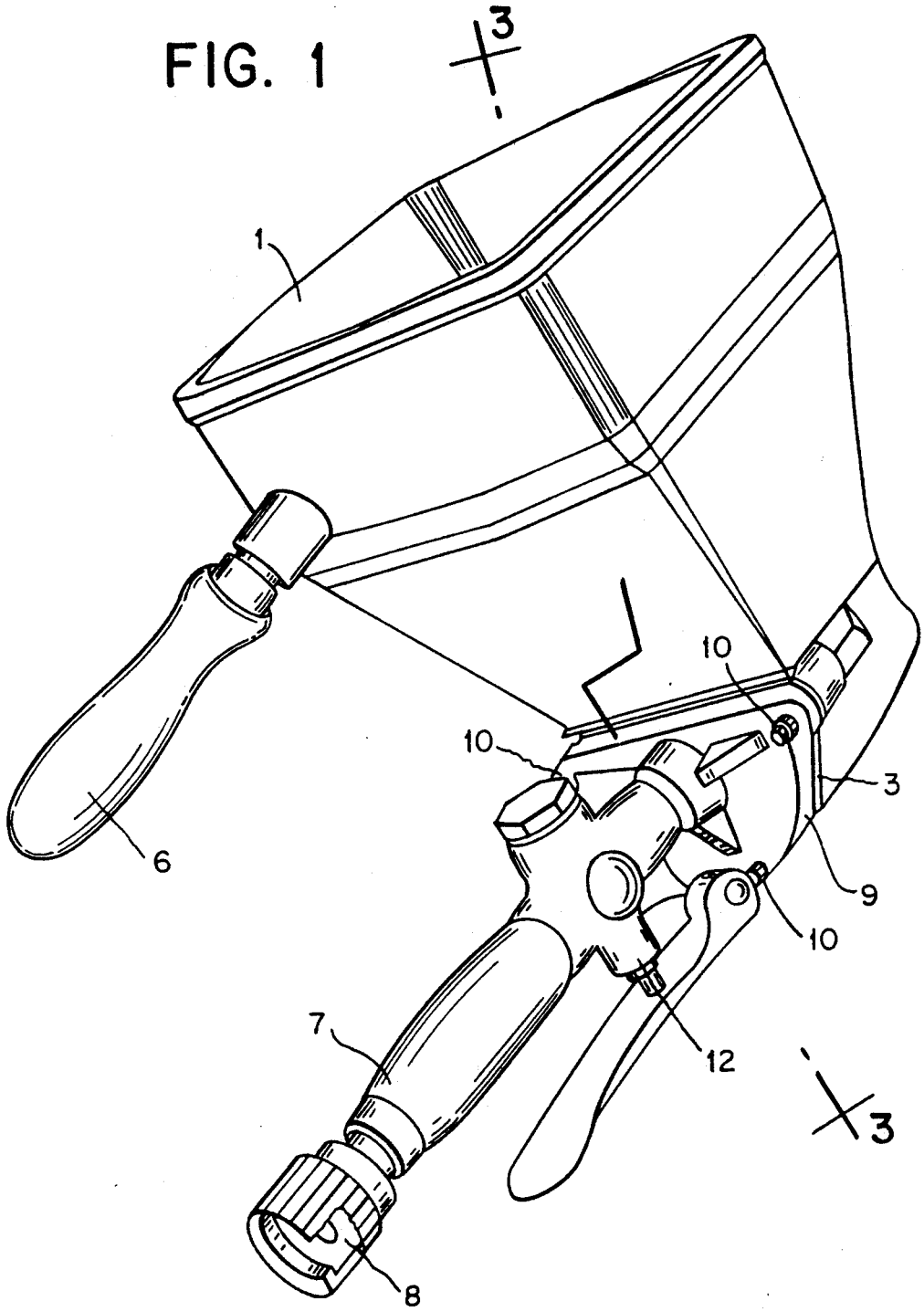
FIG. 1 is a side perspective view of the pneumatic device of the present invention.
Figure 2:
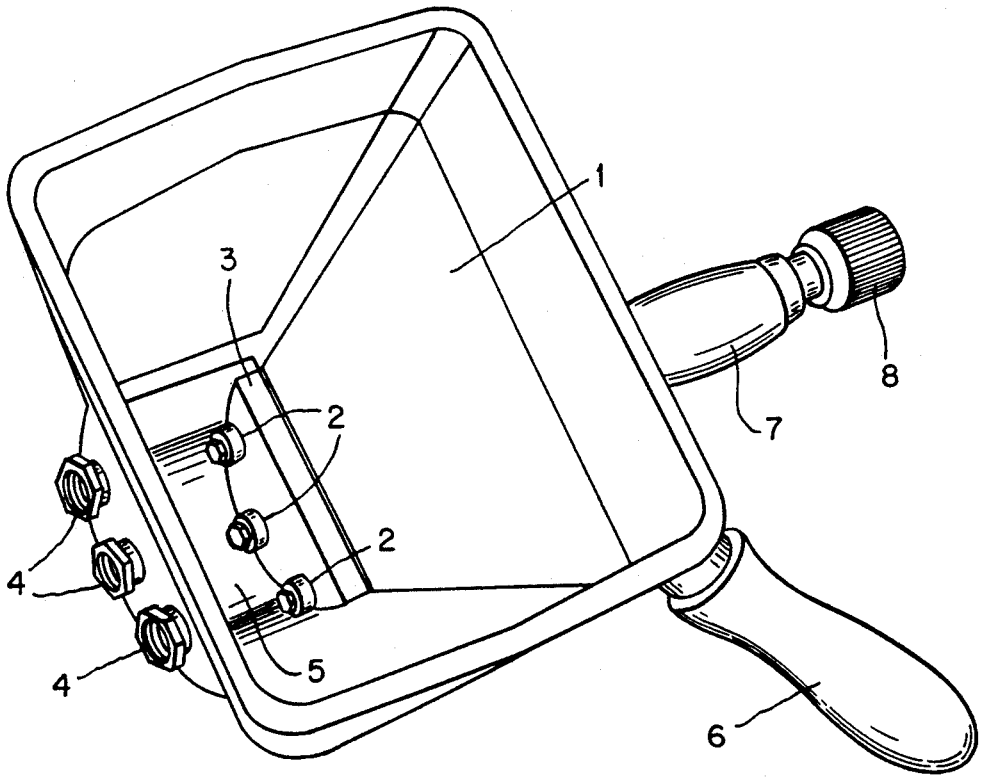
FIG. 2 is a top perspective view of the pneumatic device shown in FIG. 1.
Figure 3:
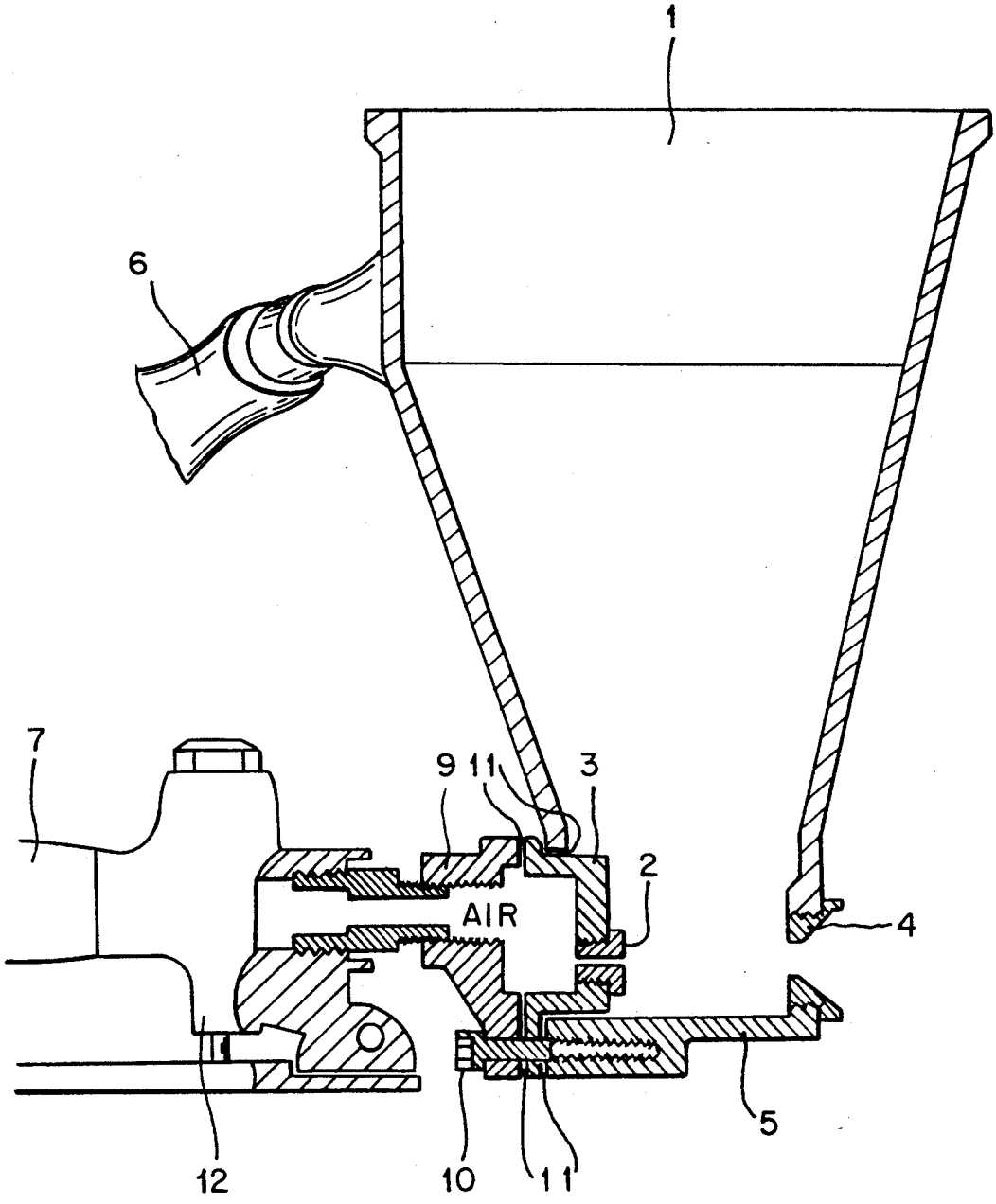
FIG. 3 is a partial section view of the pneumatic device along line 3—3 of FIG. 1.

As represented, the device consists of the receptacle 1 provided with two handles 6 and 7. The handle 6 serves for carrying of the device. To the handle 7 is connected the air intake at 8. The opening and closing of the air intake is accomplished by a valve 12 with a lever actuator. With this type of pneumatic device, the arrangements for the propulsion of the mortar are located in a tank 5 connected to the bottom of the receptacle 1 .

The hollowed-out demi-components 3 and 9 when assembled form the compression chamber, and the front of demi-component 3 includes one or a series of threaded holes which receives/receive the air-outlet nozzles 2 of various diameters. The front of the demi-component 9 receives the handle 7 attached by screws to a cut-out threaded connecting-box to permit passage of the compressed air.

The assembly of the two demi-components forming the compression chamber is fitted into the bottom of the body of the receptacle of the device onto which it is screwed by awl screws 10, the joints 11 first are provided with a joining paste or a flexible or pliable joint to achieve complete imperviousness among the three elements: the two demi-components 3 and 9 and the body of the device.

Once the compression chamber is put in place, the base of the receptacle 1 of the device then is closed on its four sides. The orifice or orifices with the outlet nose-piece or nose-pieces 4 are left for expulsion of the mortar under pressure.

These nose-pieces 4 also are removable following the same principle of threaded holes in the body of the receptacle.

The arrangement which is the subject of this invention may be used in all applications of pneumatic devices for rough-casting, pointing and filleting where liquid or paste air circulation is not accessible, to perform maintenance or a thorough cleaning and to avoid obstructions when applying the mortar.

I claim:

1. Pneumatic device for rough-casting mortar in droplet from under pressure, comprising:

a receptacle having a bottom;

a tank attached to said receptacle bottom; said tank having at least one outlet orifice for said mortar;

a compression chamber accessible for maintenance comprising two hollow half-shells;

said tank and said two hollow half-shells connected together with impervious joining.

2. Pneumatic device in accordance with claim 1, wherein one of said two hollow half-shells is connected to said tank and includes one or a series of threaded holes; and air-outlet nozzles of various diameters received in said threaded holes.

3. Pneumatic device in accordance with claim 1, wherein one of said two hollow half-shells has cut-out threaded connecting means; and a pneumatic valve and handle attached to said one of said two hollow half-shells by said cut-out threaded connecting means.

4. Pneumatic device in accordance with claim 1, wherein said at least one tank outlet orifice has a removable nose-piece contained therein.

5. Pneumatic device in accordance with claim 1, wherein the tank and the two hollow half-shells are connected together in a flexible manner by awl screws.

* * * * *